US006508544B1

(12) United States Patent
Sasaki et al.

(10) Patent No.: US 6,508,544 B1
(45) Date of Patent: Jan. 21, 2003

(54) INK-JET HEAD AND PRINTER USING THE SAME

(75) Inventors: Masayuki Sasaki, Kawasaki (JP); Hiromitsu Soneda, Kawasaki (JP); Koichi Sanpei, Kawasaki (JP); Mutsuo Watanabe, Kawasaki (JP); Takumi Kawamura, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/618,563

(22) Filed: Jul. 18, 2000

(30) Foreign Application Priority Data

Oct. 19, 1999 (JP) ..... 11-297399

(51) Int. Cl.[7] ..... B41J 2/17
(52) U.S. Cl. ..... 347/84
(58) Field of Search ..... 347/84, 85, 86, 347/89, 49, 65

(56) References Cited

U.S. PATENT DOCUMENTS 4,364,059 A * 12/1982 Nagayama ..... 347/89
4,854,444 A * 8/1989 Iwamoto ..... 198/750.7
5,886,719 A * 3/1999 Zepeda ..... 347/85
5,966,156 A * 10/1999 Scheffelin et al. ..... 347/86
6,203,149 B1 * 3/2001 Watanabe et al. ..... 347/86
6,325,498 B1 * 12/2001 Higuma et al. ..... 347/86

FOREIGN PATENT DOCUMENTS

| | | |
|---|---|---|
| JP | 07-52399 | 2/1995 |
| JP | 10-258509 | 9/1998 |
| JP | 10-329332 | 12/1998 |

* cited by examiner

*Primary Examiner*—John Barlow
*Assistant Examiner*—K. Feggins
(74) *Attorney, Agent, or Firm*—Armstrong, Westerman & Hattori, LLP

(57) ABSTRACT

An ink-jet head includes a head portion having a plurality of head segments and an ink feeding portion, where ink is supplied such that pipes each have one end connected to the head portion and the other end connected to one of ink feeding paths of the ink feeding portion. The pipes are held by elastic ring-shaped members that are further sidewise held by rigid ring-shaped members and vertically sandwiched between the ink feeding paths and an upper end portion of the head portion.

18 Claims, 12 Drawing Sheets

INK-JET HEAD AND PRINTER USING THE SAME

BACKGROUND OF THE INVENTION

1. Field of the Invention

The present invention generally relates to an ink-jet head used in a copy machine, a word processor, or a machine integrating these and to a printer provided with such an ink-jet head.

2. Description of the Related Art

Conventionally, an ink-jet head used in a printer mainly includes a head portion and an ink feeding portion. Further, the ink feeding portion usually refers to an ink cartridge or an ink tank.

FIG. 1 is a cross-sectional diagram for illustrating an ink feeding passage of a conventional ink-jet head 7.

In the case of the ink cartridge, as shown in FIG. 1, the ink-jet head 7 includes a head portion 1, a pipe 2, an ink cartridge 3, an ink cartridge holder 4, an ink feeding path 5, and an adhesive 6 made up of a silicone rubber. The ink feeding passage is formed between the head portion 1 and the ink cartridge 3 by the pipe 2 and the ink feeding path 5. In other words, the pipe 2 has one end 2*a* thereof inserted into an aperture 5*a* of the ink feeding path 5 and sealed up by the adhesive 6. Another end 2*b* is connected to the head portion 1, and the ink feeding passage is thus formed.

The ink-jet head 7 is integrated by screwing together (not shown) a frame body la of the head portion 1 and the ink cartridge holder 4.

The conventional ink-jet head 7, however, suffers from the following disadvantages:

Firstly, the ink-jet head 7 has a difficulty in positioning of the parts thereof. If the parts cannot be positioned with accuracy during an assembling process, a stress, caused when the frame body 1*a* of the head portion 1 and the ink cartridge holder 4 are tightened by screws after the end 2*a* of the pipe 2 is positioned and sealed up in the aperture 5*a* of the ink feeding path 5, is applied to a sealed-up portion. Such a stress may also be caused when the installed ink-jet head 7 is used in a printer. As a result, the sealed-up portion may crack and ink leakage may occur.

Further, if the stress is applied sideward to the end portion 2*a* of the pipe 2, the other end portion 2*b* of the pipe 2 may be damaged, or an ink-storing member 8 that is integrated with the pipe 2 may be separated from a head segment 9.

Furthermore, using the adhesive 6 made up of the silicone rubber brings about another disadvantage that desiccation and solidification of the silicone-rubber adhesive 6 take much time.

In the case of the ink tank, on the other hand, the ink feeding path 5 is a flexible tube having one end thereof connected to the pipe 2. Unlike the ink-jet head 7 using the ink cartridge, this configuration of using the ink tank can avoid the inaccurate positioning of the parts. If, however, the flexible tube is subjected to extreme motion, a stress caused thereby is applied to the pipe 2, and similarly, the pipe 2 may be damaged or the ink-storing member 8 may be separated from the head segment 9. As a result, the leakage of the ink may occur.

SUMMARY OF THE INVENTION

It is a general object of the present invention to provide an ink-jet head and a printer using the same, in which the above disadvantages can be overcome.

Another and a more specific object of the present invention is to provide an ink-jet head and a printer using the same, which can prevent pipes thereof through which ink is conveyed from being damaged and thereby can avoid ink leakage.

The above objects and other objects of the present invention are achieved by an ink-jet head comprising:

a head portion;

an ink feeding portion;

an ink feeding passage connecting the head portion and the ink feeding portion, the ink feeding passage comprising: an elastic ring member holding the ink feeding passage; and a rigid ring portion holding the elastic ring member; and a fixing mechanism pressing the elastic ring members between the head portion and the ink feeding portion.

The above objects and other objects of the present invention are achieved by a printer having an ink-jet head, the ink-jet head comprising:

a head portion;

an ink feeding portion;

an ink feeding passage connecting the head portion and the ink feeding portion, the ink feeding passage comprising: an elastic ring member holding the ink feeding passage; and a rigid ring portion holding the elastic ring member; and a fixing mechanism pressing the elastic ring members between the head portion and the ink feeding portion.

A better understanding of the features and advantages of the present invention will be obtained by reference to the following detailed description of the invention and accompanying drawings which set forth an illustrative embodiment in which the principles of the invention are utilized.

DETAILED DESCRIPTION OF THE PREFERRED EMBODIMENTS

With reference to the drawings, preferred embodiments of the present invention will be described below.

Figure 2:
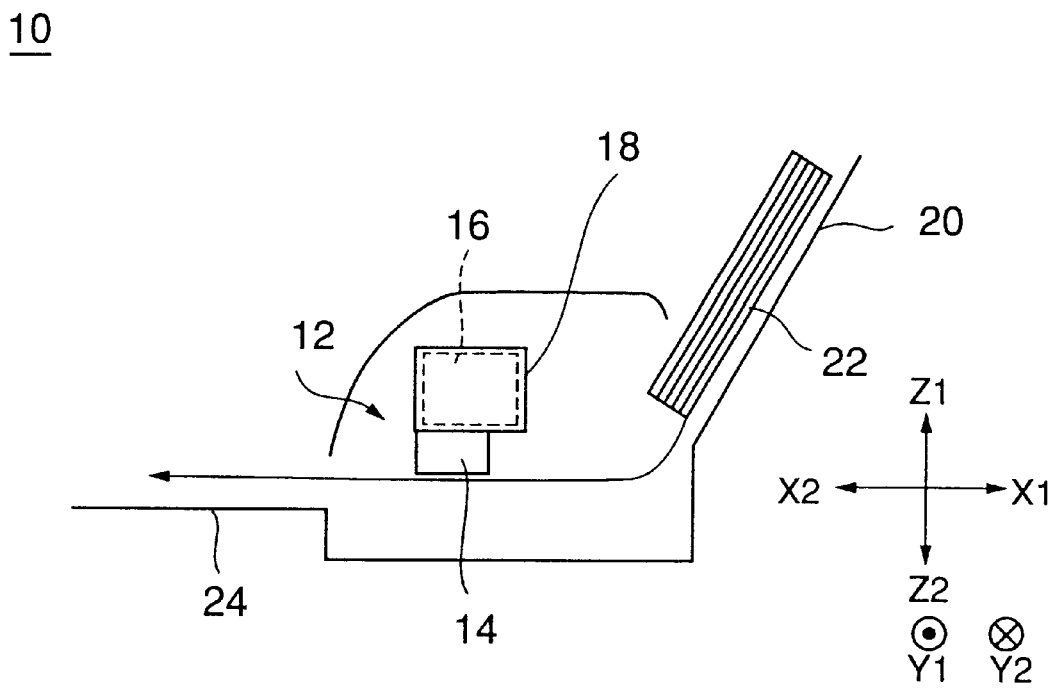
FIG. 2 is a cross-sectional diagram schematically showing a printer using an ink-jet head of a first embodiment according to the present invention.

FIG. 2 schematically shows a configuration of a printer 10 of a first embodiment according to the present invention.

Figure 1:
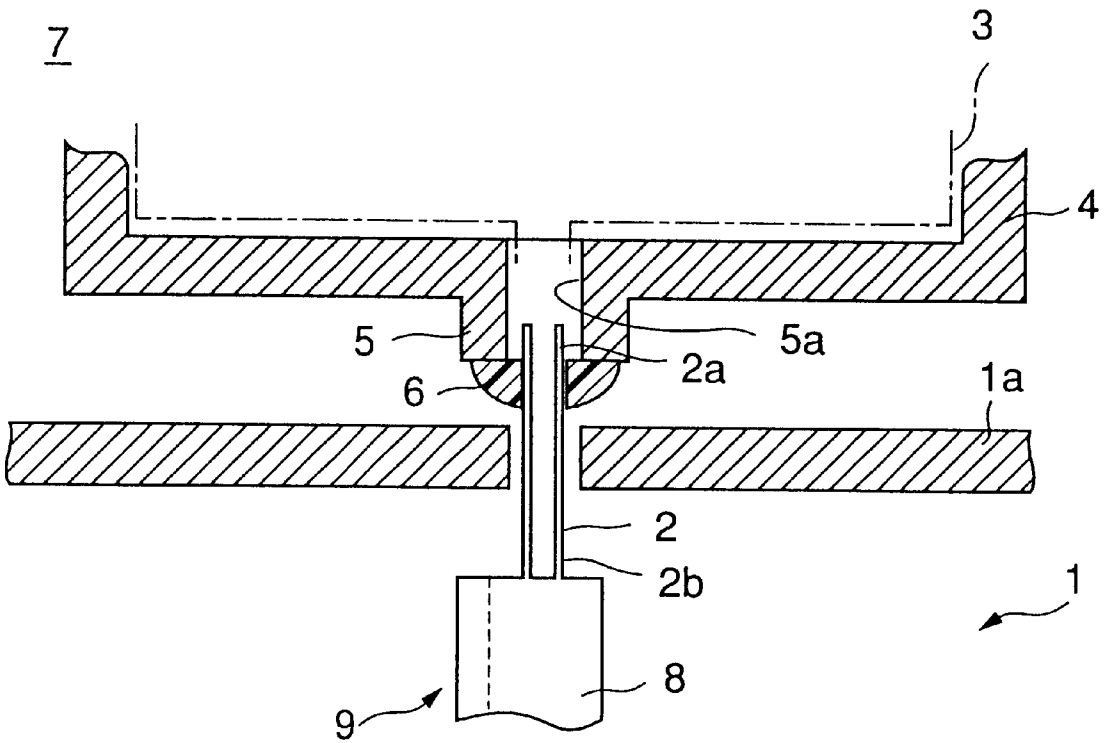
FIG. 1 PRIOR ART
FIG. 1 is a cross-sectional diagram for illustrating an ink feeding passage of a conventional ink-jet head.

As shown in FIG. 2, the printer 10 is provided with an ink-jet head 12, which may belong to a piezoelectric type. The ink-jet head 12 includes a head portion 14 and an ink feeding portion. The ink feeding portion may further have an ink cartridge 16 and an ink cartridge holder 18. The ink cartridge holder 18 is mounted on the head portion 14. A stack of paper 22 is placed on a paper-feeding tray 20 and a sheet of paper is individually conveyed from the stack 22 to a position under the ink-jet head 12 in a direction X2 as shown in FIG. 1. The sheet is then printed with an image or character by the ink-jet head 12 and discharged outside to a paper-discharging tray 24.

With respect to the head portion 14, a description is given below by referring to FIGS. 3 through 8.

Figure 3:
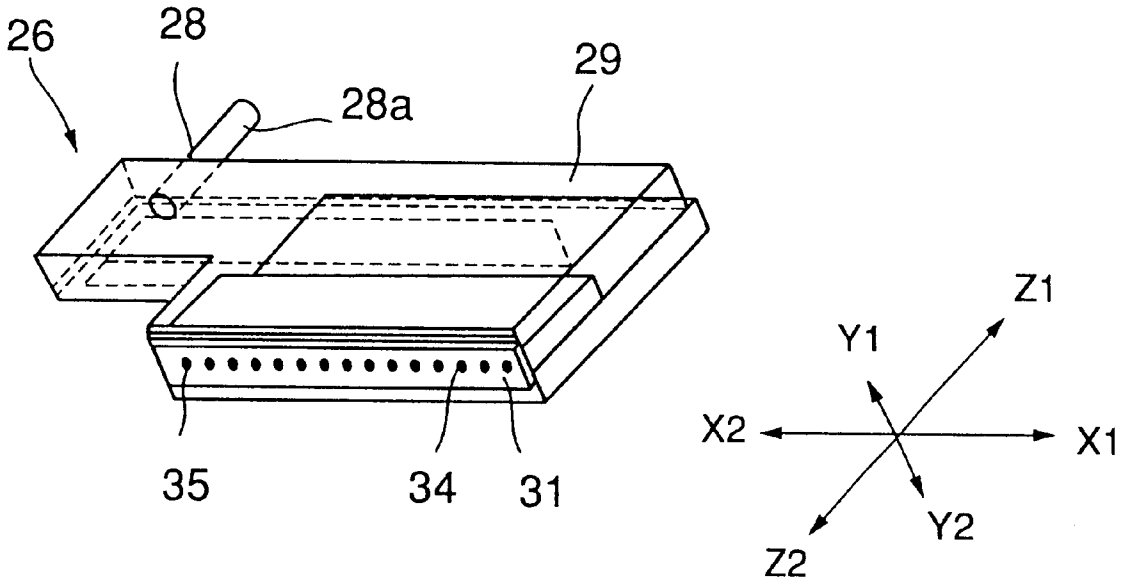
FIG. 3 is a perspective diagram schematically showing a head segment of the ink-jet head of the first embodiment according to the present invention.
Figure 4:
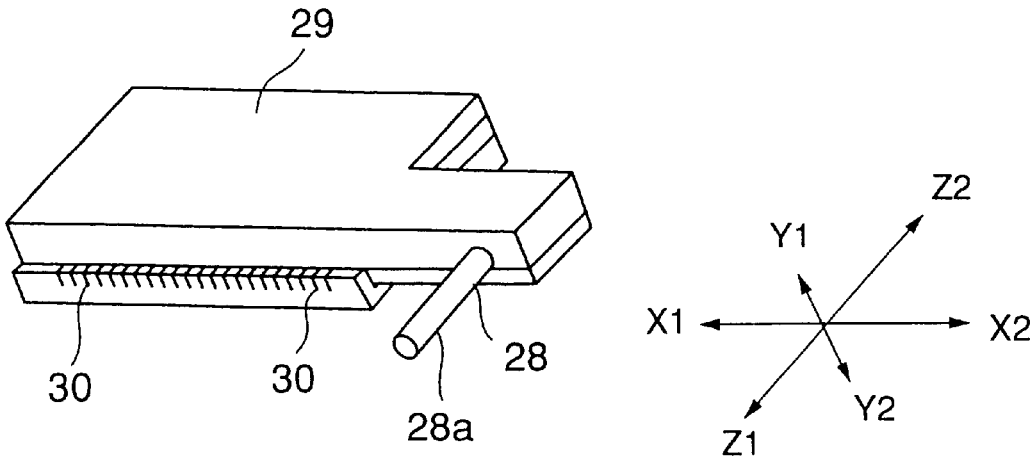
FIG. 4 is a perspective diagram schematically showing an inversion of the head segment in FIG. 3.

FIGS. 3 and 4 are two diagrams showing an outward appearance of a head segment 26 forming a main body of the head portion 14 together with other similar head segments 26. FIG. 3 shows the head segment 26 from a direction Z2, and FIG. 4 shows the same from a direction Z1 opposite to the direction Z2.

As shown in the two diagrams, the head segment 26 includes a pipe 28, an ink-storing member 29, a plurality of piezoelectric elements 30 (see FIG. 4) and a nozzle plate 31. The pipe 28 has an end portion 28*a* thereof projected out of and connected to one side of the head segment 26 so that ink can be introduced into the head segment 26 from the pipe 28. The plurality of piezoelectric elements 30 are configured to expose end portions thereof on the same side (see FIG. 4). The nozzle plate 31, on the other hand, is provided on an opposite side of the head segment 26 and has a plurality of nozzles 35 from which the ink droplets are ejected. A detailed description with respect to the head segment 26 will be given later.

Figure 5:
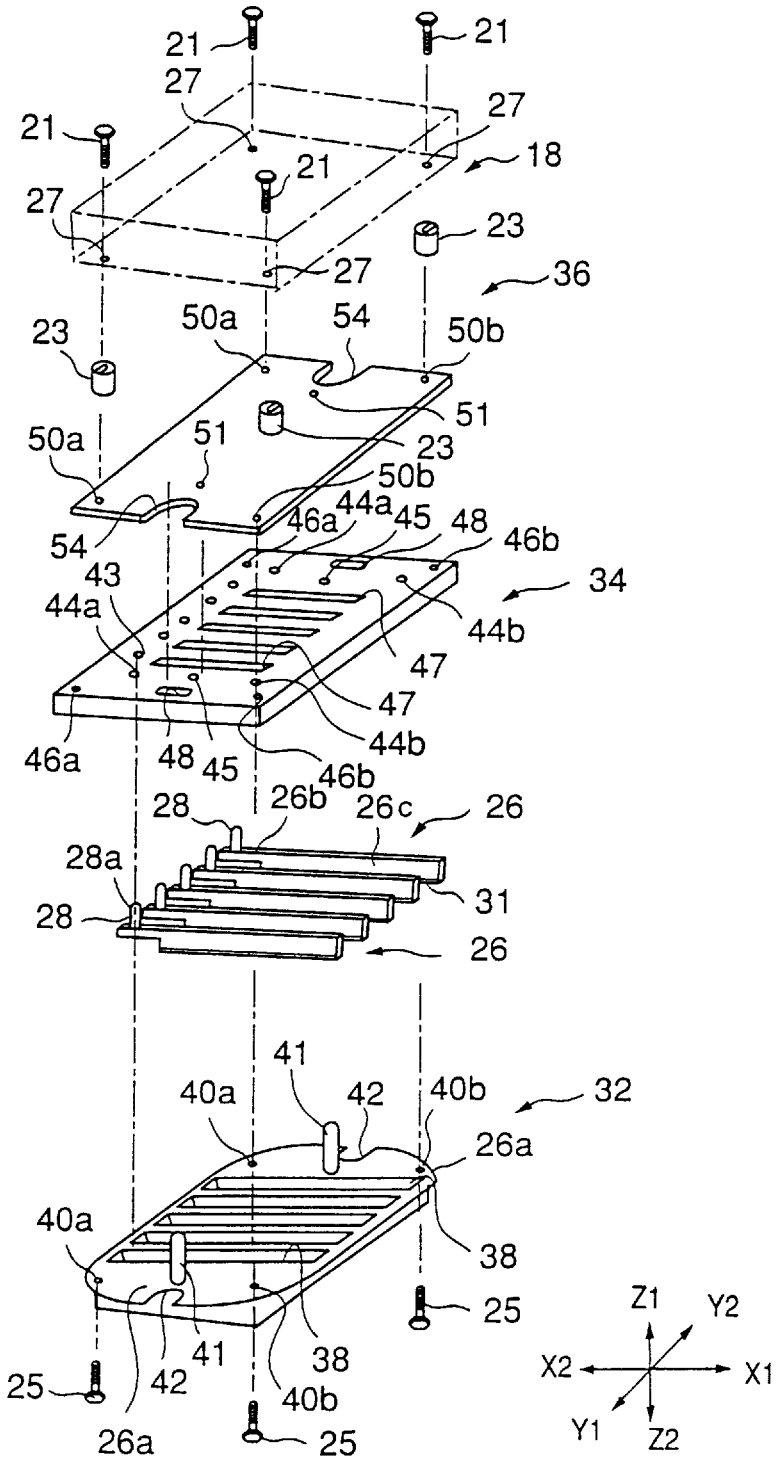
FIG. 5 is an exploded perspective diagram schematically showing the ink-jet head of the first embodiment according to the present invention.

FIG. 5 is an exploded and perspective diagram showing the ink-jet head 12 of the first embodiment.

As shown in this diagram, the ink-jet head 12 is formed by mainly assembling a frame body 32, a plurality of the head segments 26, a frame lid 34, a printed substrate 36 and the ink cartridge holder 18.

Specifically, on the frame body 32, the head segments 26 are mounted such that each portion 28*a* of the pipes 28 is stood vertically. On the head segments 26, the frame lid 34 is disposed. Furthermore, on the frame lid 34, the printed substrate 36 is mounted. After these parts are screwed integrally together, the head portion 14 is formed. Then, the ink cartridge holder 18 is attached to the thus-formed head portion 14. Thus, the ink-jet head 12 is formed.

As shown in FIG. 5, with respect to the frame body 32, it is approximately shaped like a rectangular member, where a plurality of through-groove portions 38 corresponding to the respective head segments 26 are formed along a direction of X1–X2, and two flanges 26*a* are expanded along a direction of Y1–Y2. Further, a plurality of holes 40*a*, 40*b* are formed on the two flanges 26*a*, and two positioning projections 41 are formed between each two holes 40*a* and 40*b*. Furthermore, two concave portions 42 are formed on respective end portions of the flanges 26*a*.

With respect to the head segments 26, main bodies 26*c* thereof are accommodated in the through-groove portions 38, the nozzle plates 31 are exposed to the bottom of the frame body 32, and step portions 26*b* thereof, where the protruding pipes 28 are formed, are configured to stick out of the frame body 32 in the direction of X2.

With respect to the frame lid 34, it is a plate-shaped member, where a plurality of slits 47 corresponding to the respective head segments 26 are formed along the direction of X1–X2, and a plurality of through-holes (apertures) 38 into which the corresponding pipes 28 can be inserted are formed. Further, the frame lid 34, in the direction of Y1–Y2, has two end portions, where a plurality of screw holes 44*a*, 44*b* corresponding to the holes 40*a*, 40*b*, two holes 45 into which the projections 41 are inserted are formed. Furthermore, on the two end portions of the frame lid 34, a plurality of holes 46*a*, 46*b*, and holes 48 are formed. In addition, the piezoelectric elements 30 of the head segments 26 are arranged to face to the slits 47 of the frame lid 34.

With respect to the printed substrate 36, it serves as a driving portion for displacing the piezoelectric elements 30, and in the direction of Y1–Y2 has two end portions. On the two end portions, there are formed a plurality of holes 50*a*, 50*b* corresponding to the holes 46*a*, 46*b*, two holes 51 corresponding to the two holes 45, and two concave portions 54 corresponding to the holes 48.

By inserting the projections 41 into the holes 45 and the holes 51, the frame lid 34 and the printed substrate 36 are positioned on the frame body 32. Further, by tightening screws 25 in the screw holes 44*a*, 44*b* via the holes 40*a*, 40*b*, the frame body 32 and the frame lid 34 are integrated.

On four corners of the ink cartridge holder 18, there are formed holes 27. By inserting screws 21 into the holes 27, collars 23, holes 50*a*, 50*b*, holes 46*a*, 46*b* and fixing them, the printed substrate 36 and the ink cartridge holder 18 are attached to the head portion 14. Herein, the collars 23 serve for forming a predetermined space between the printed substrate 36 and the ink cartridge holder 18. In addition, the screws 21 and the collars 23 form a fixing mechanism for fixing the head portion 14 and the ink feeding portion formed by the ink cartridge 16 and ink cartridge holder 18.

In addition, by inserting screws into the holes 48, the ink-jet head 12 is fixed on a head carriage (not shown).

Figure 6:
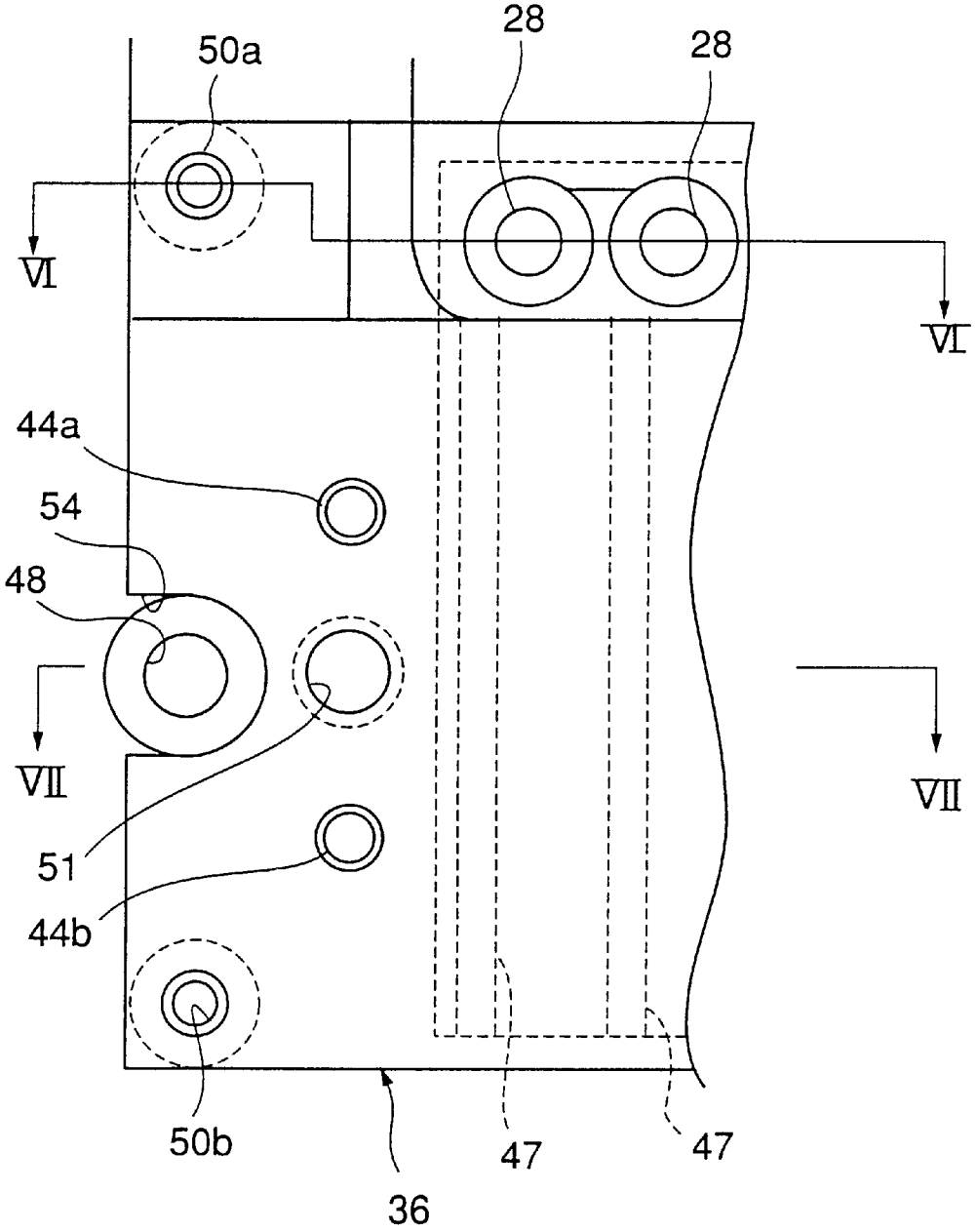
FIG. 6 is a top view partly showing the ink-jet head of the first embodiment according to the present invention.
Figure 7:
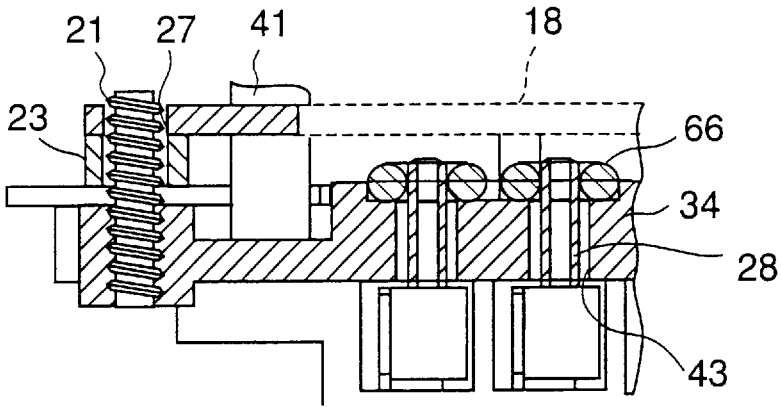
FIG. 7 is a cross-sectional diagram taken along line VI—VI in FIG. 6.
Figure 8:
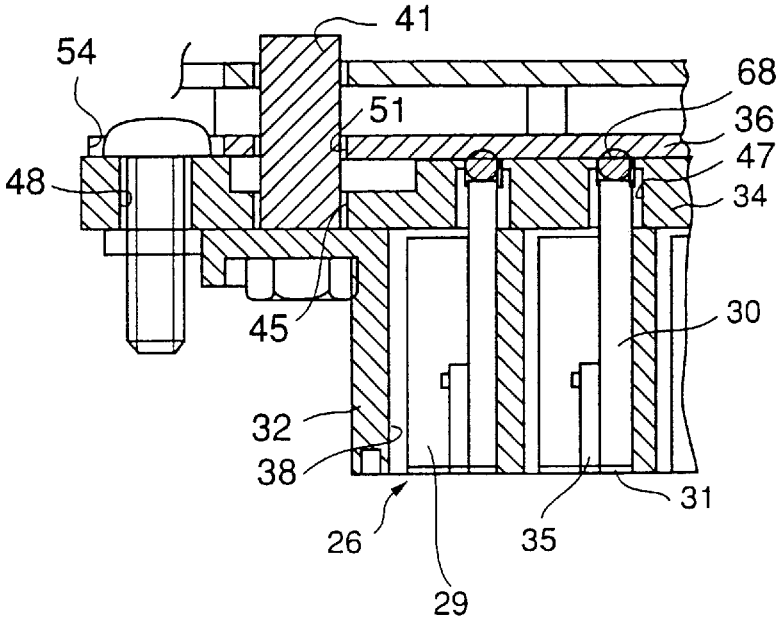
FIG. 8 is a cross-sectional diagram taken along line VII—VII in FIG. 6.

FIG. 6 is a top view, seen from a direction of Z1 in FIG. 5, showing the head portion 14 that is completed as described above. FIG. 7 is a cross-sectional view taken along line VI—VI in FIG. 6. FIG. 8 is a cross-sectional view taken along line VII—VII in FIG. 6.

Herein, a reference numeral 66 in FIG. 7 denotes a plurality of O-rings made up of a rubber material serving as elastic ring members that will be described later. Also, a reference numeral 68 in FIG. 8 denotes a plurality of stick-shaped junction members made up of an anisotropic conductive material. The junction members are disposed in the respective slits 47 so as to connect the printed substrate 36 and the piezoelectric elements 30 electrically.

Next, a brief description will be given below with respect to the action of the ink-jet head 12 that is configured as above described, by referring to FIGS. 7 and 8.

The ink cartridge 16 may contain various colors of ink such as yellow, magenta, cyan, black and the like.

The ink supplied from the ink cartridge 16 is conveyed to the head segments 26 via the pipes 28. Then, when the piezoelectric elements 30 are displaced by the driving of the printed substrate 36 to which electric voltage is applied, the ink droplets are ejected out of the nozzles 35 and thus a printing is made on a sheet of the paper 22.

Next, a description is given below with respect to a configuration of an ink feeding passage formed between the ink cartridge holder 18 and the head portion 14, by referring to FIGS. 9 and 10.

The head segments 26 are, as previously described, inserted into the respective through-groove portions 38 of the frame body 32 (see FIG. 8).

Figure 9:
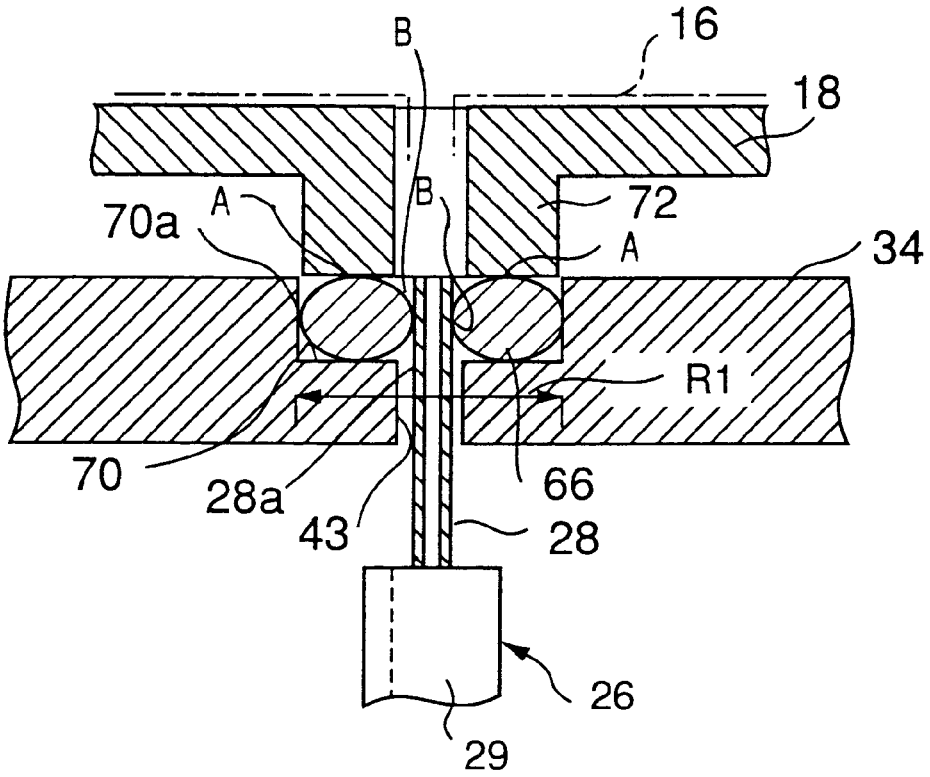
FIG. 9 is a cross-sectional diagram for illustrating an ink feeding passage of the ink-jet head of the first embodiment according to the present invention.
Figure 10:
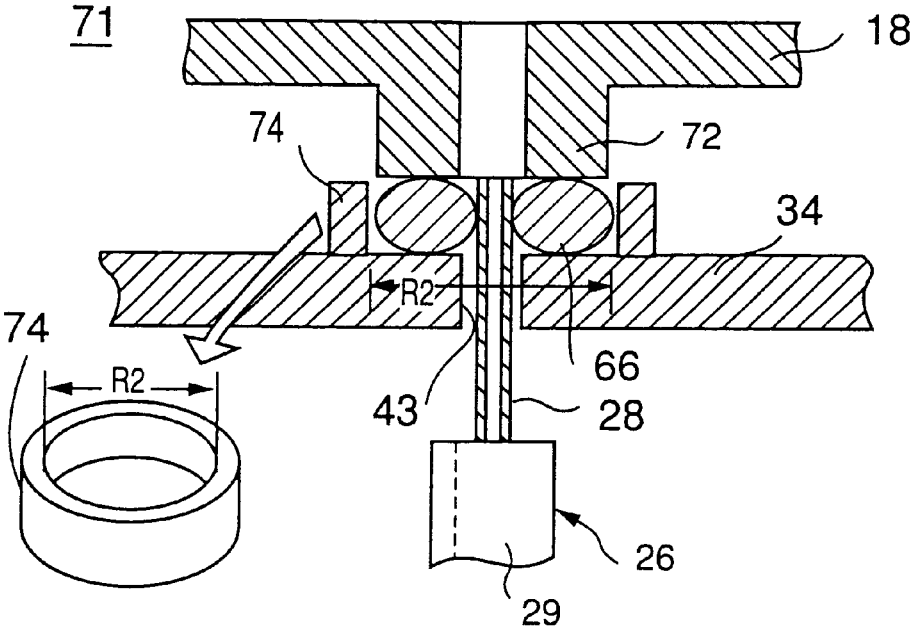
FIG. 10 is a cross-sectional diagram for illustrating an ink feeding passage of a first modification of the ink-jet head of the first embodiment according to the present invention.

As shown in FIG. 9, the frame lid 34 has a groove portion 70 that communicates and is coaxial with the hole 43. The groove portion 70 has an enlarged aperture for receiving an O-ring 66 that is provided in advance in an inner-wall portion (rigid ring portion) 70*a* thereof. Herein, an outside diameter of the O-ring 66 before being provided in the groove portion 50 is slightly larger than an inside diameter R1 of the groove 70, so that when provided therein, the O-ring 66 receives a stress applied toward a center thereof.

Referring back to FIG. 5, when the frame lid 34 is attached to the frame body 32, the end portions 28*a* of the pipes 28 are inserted into the holes 43 and positioned by pins 40*a* through 40*c*. At this time, as shown in FIG. 9, the end portion 28*a* of the pipe 28 is held such that it is slightly stressed by the O-ring 66.

Then, the ink cartridge holder 18 is installed on the frame lid 34, and by adjusting the screws 21, lengths of collars 23 can be changed. The fastening of the screws 21 is adjustable, and if optimum length of the collar 23 is predetermined, then optimum fastening can be obtained while the screws 21 are completely tightened. Thus, the O-ring 66 receives a downward stress from the ink feeding path 72 as shown in FIG. 9. In this configuration, when assembly of the ink-jet head 12 is completed, the O-ring 66 is deformed sideward and vertically so as to hold the pipe 28. The ink feeding passage is thus formed by the ink feeding path 72 and the pipe 28, and is tightly sealed up at portions A and B in FIG. 9.

If there is no groove portion 70, the O-ring 66 does not receive the sideward stress and may be expanded due to an increase in temperature when the printer 10 is in use. When the temperature is decreased, it is difficult for the O-ring 66 to return its original form. In this case, the O-ring 66 is shrunk vertically and thereby the sealed-up portion A may be damaged. In contrast, according to the configuration of the present invention, the sideward deformation of the O-ring 66 can be prevented by the groove portion 70 and the above-mentioned disadvantages can be avoided.

According to the first embodiment of the present invention, even if the parts of the printer 10 and the ink-jet head 12 are not assembled with accuracy, since the O-ring 66 can be deformed elastically, an ink feeding passage formed by the ink feeding path 72 and the pipe 28 can be kept in the sealed-up state all the time by the O-ring 66. As a result, the ink leakage can be avoided.

Further, when the ink-jet head 10 is completed or is in use, even if the pipe 28 receives a stress in a diameter direction due to the pipe 28 being not positioned with accuracy and the pipe 28 is shifted some from a center of the ink feeding path 72, since the stress can be absorbed by the elastic deformation of the O-ring 66, damage to the pipe 28 can be avoided.

Next, a description will be given below with respect to an ink feeding passage formed between the ink cartridge 18 and the head portion 14 of an ink-jet head 71 as a first modification of the ink-jet head 12 of the first embodiment, by referring to FIG. 10. In addition, parts, which are the same as those used in the first embodiment, are given the same reference numerals and a description thereof is omitted.

Unlike the first embodiment, in the first modification, a cylindrical metal ring member (rigid ring member) 74 is provided for holding the O-ring 66 instead of the groove portion 70.

The ring member 74 loosely holds the O-ring 66, and the O-ring 66 before attachment is configured to have an outside diameter slightly larger than an inside diameter R2 of the ring member 74 such that, for example, the outside diameter of the O-ring 66 before the attachment may be 5.4 mm, whereas the inside diameter R2 may be 5.3 mm. As a result, the attachment of the O-ring 66 to the ring member 74 can be performed easily.

Figure 11A:
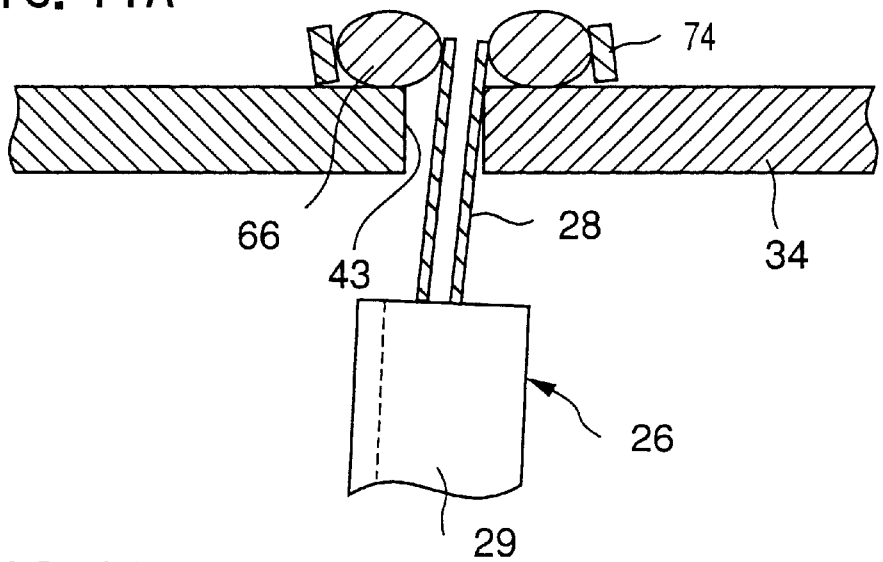
FIGS. 11A and 11B are cross-sectional diagrams for illustrating a pipe-shifted state of the ink feeding passage of a first modification of the ink-jet head of the first embodiment according to the present invention, FIG. 11A showing that the pipe is inserted into a hole of a frame lid, FIG. 11B showing that an ink cartridge holder is further attached thereto.
Figure 11B:
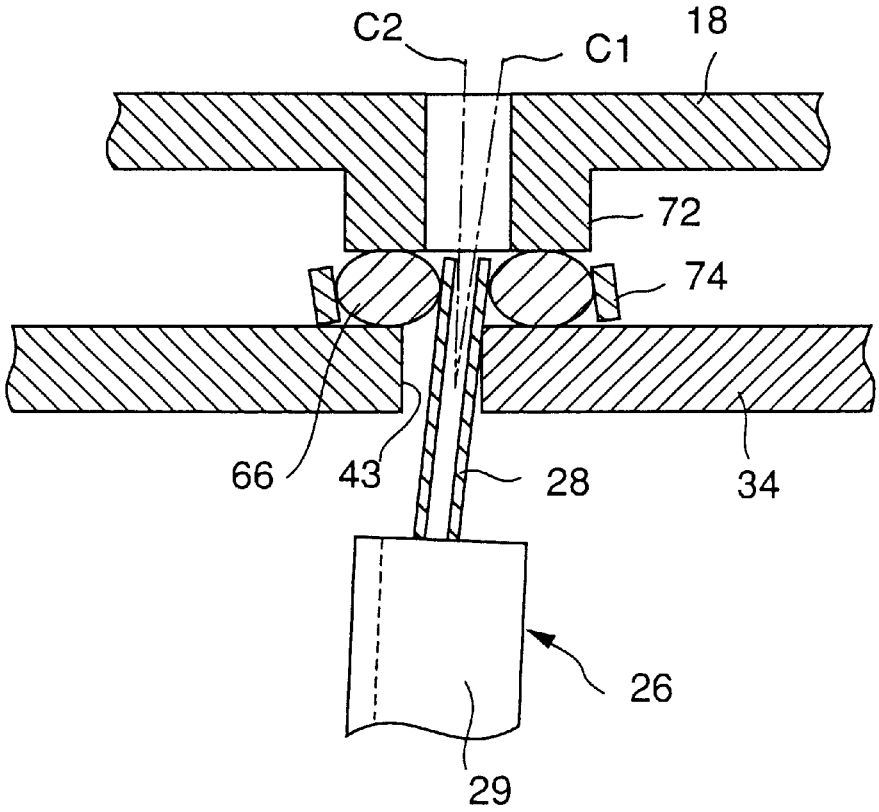

FIGS. 11A and 11B are cross-sectional diagrams for illustrating a pipe-shifted state of the ink feeding passage of a first modification of the ink-jet head 12 of the first embodiment according to the present invention. FIG. 11A shows that the pipe 28 is inserted into a hole of the frame lid 34. FIG. 11B shows that the ink cartridge holder 18 is further attached thereto.

As shown in FIG. 11B, when a central line C1 of the end portion 28*a* of the pipe 28 is slightly shifted from a central line C2 of the hole 43 due to inaccuracy of assembling the parts of the ink-jet head 71, since the ring member 74 is movably attached to the frame lid 34, it can be coaxial with the pipe 28 in such a shifted state.

Then, as shown in FIG. 11B, the ink cartridge holder 18 can be attached to the frame lid 34 even where the pipe 28, the O-ring 66 and the ring member 74 are kept in the shifted state.

Accordingly, even if the parts are not assembled with accuracy, the pipe 28 will not receive the stress from the O-ring 66. Also, even in the shifted state, the ink feeding passage can be certainly sealed up by the O-ring 66.

Figure 12:
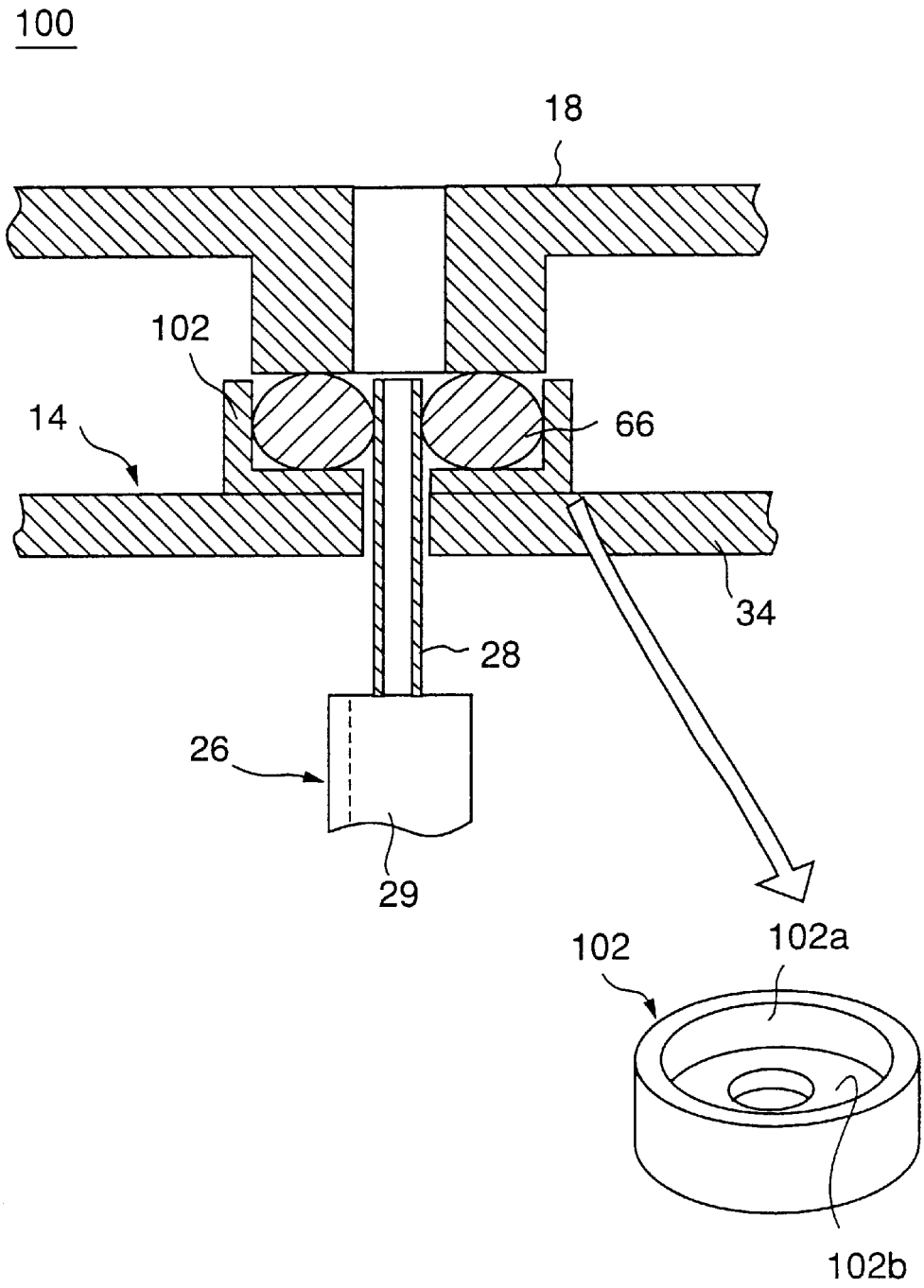
FIG. 12 is a cross-sectional diagram for illustrating an ink feeding passage of a second modification of the ink-jet head of the first embodiment according to the present invention.

Next, a description will be given below with respect to an ink feeding passage between the ink cartridge 18 and the head portion 14 of an inkjet head 100 as a second modification of the ink-jet head 12 of the first embodiment, by referring to FIG. 12.

Unlike the ring member 74 in the first modification, a ring member 102 in the second modification has an inner wall 102*a* where a bottom portion 102*b* is formed with an aperture.

According to the ink-jet head 100 of the second modification, during assembly of the ink-jet head 100, the O-ring 66 can be in advance installed in the ring member 102 and therefore the assembly can be performed easily.

Next, a description is given below with respect to an ink-jet head 76 of a second embodiment according to the present invention, by referring to FIG. 13.

Unlike the ink-jet head 12 of the first embodiment and its modifications where the ink cartridge 16 is used, the ink-jet head 76 of the second embodiment has an ink tank 78 serving as the ink feeding portion.

The ink tank 78 is provided with a flexible tube 80 serving as the ink feeding path. The flexible tube 80 has one end thereof connected to the ink tank 78 and the other end thereof connected to the pipe 28 of the head portion 14.

Figure 13:
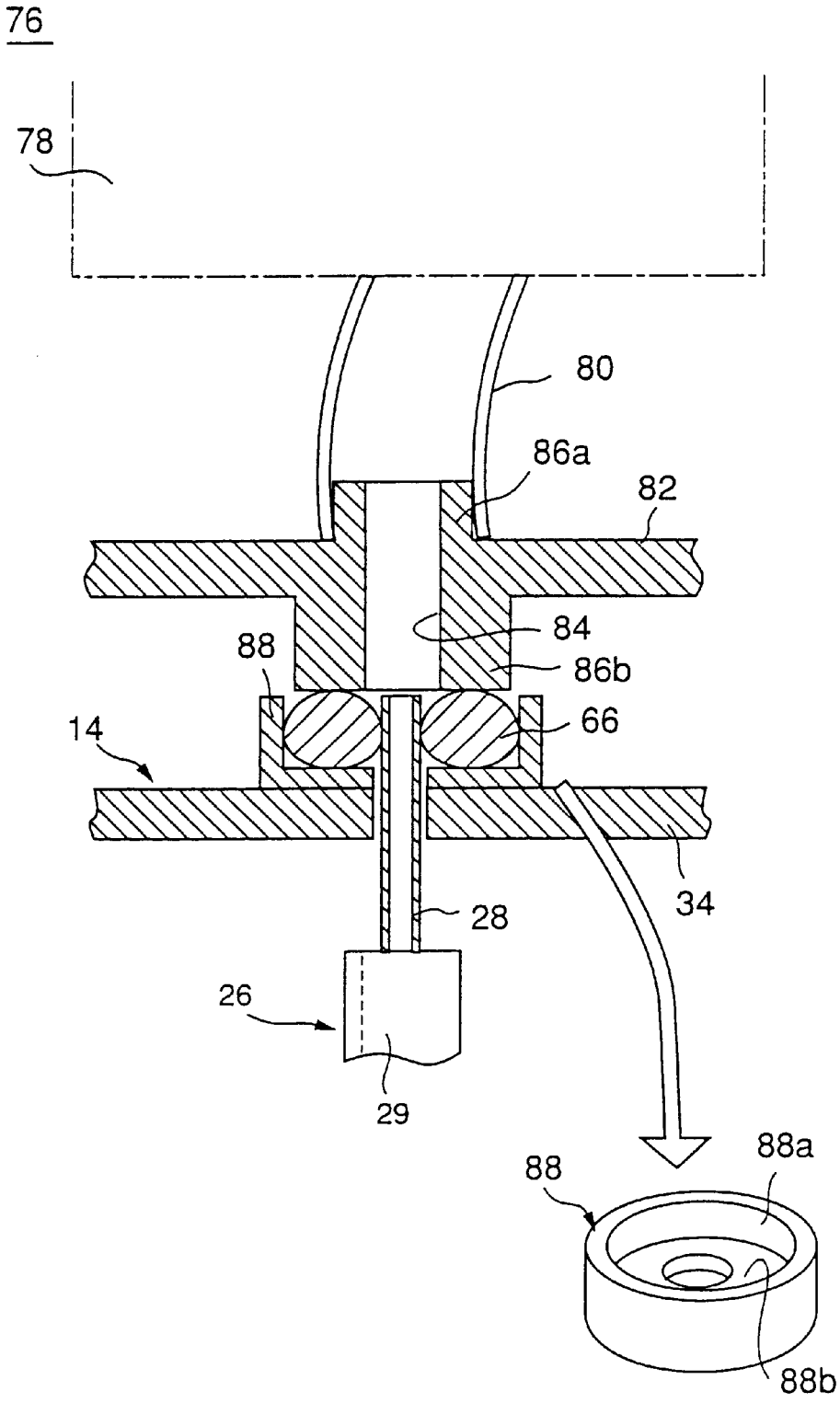
FIG. 13 is a cross-sectional diagram for illustrating an ink feeding passage of an ink-jet head of a second embodiment according to the present invention.

As shown in FIG. 13, in this embodiment, a supporting member 82 is provided which has a through-hole 84, an upward projection 86*a* and a downward projection 86*b*. The upward projection 86*a* of the supporting member 82 is connected to the other end of the flexible tube 80. The downward projection 86*b* is configured to apply a stress on the O-ring 66. In this configuration, the supporting member 82 serves as the frame lid 34 of the first embodiment.

Also, a ring member 88 as the rigid ring member, which is the same as that in the second modification, has a ring wall 88*a* where a bottom portion 88*b* with an aperture is formed.

According to the ink-jet head 76 of the second embodiment, since the flexible tube 80 is not directly connected to the pipe 28 and the pipe 28 is held by the O-ring 66 and the ring member 88, even if the flexible tube 80 is moved, a stress caused thereby is not applied to the pipe 28. As a result, the damage to the pipe 28 can be avoided. Further, during the assembly of the ink-jet head 76, the O-ring 66 can be installed in advance in the ring member 88 and this can make the assembly easy.

The above description is provided in order to enable any person skilled in the art to make and use the invention and sets forth the best mode contemplated by the inventors for carrying out their invention.

The present application is based on Japanese priority application No. 11-297399 filed on Oct. 19, 1999, the entire contents of which are hereby incorporated by reference.

It should be understood that various alternatives to the embodiments of the invention described herein may be employed in practicing the invention. It is intended that the following claims define the scope of the invention and that structures and methods within the scope of these claims and their equivalents be covered thereby.

What is claimed is:

1. An ink-jet head comprising:

a head portion;

an ink feeding portion;

an ink feeding passage connecting said head portion and said ink feeding portion, said ink feeding passage comprising: an elastic ring member holding said ink feeding passage; and a unitary rigid ring member unitary to said ink feeding portion for housing said elastic ring member; and a fixing mechanism for pressing said elastic ring member between said head portion and said ink feeding portion such that said elastic ring deforms uniformly in a sideward direction and a vertical direction.

2. The ink-jet head as claimed in claim 1, wherein:

said head portion includes a frame lid for accommodating a plurality of head segments;

said ink feeding portion includes an ink cartridge and an ink cartridge holder;

said ink feeding passage is formed by a pipe and an ink feeding path which communicate with each other;

said pipe is formed in said head portion so as to protrude out of an aperture portion formed in said frame lid of said head portion; and said ink feeding path is formed in and protrude out of said ink feeding portion.

3. The ink-jet head as claimed in claim 2, wherein:

said elastic ring member holds said pipe of said ink feeding passage;

said aperture portion is step-shaped with an enlarged aperture facing to said ink feeding portion; and said rigid ring portion is a wall portion of said enlarged aperture.

4. The ink-jet head as claimed in claim 3, wherein said elastic ring member, which is sandwiched between said ink feeding path and said frame lid of said head portion, is movable together with said pipe in a diameter direction of said pipe.

5. The ink-jet head as claimed in claim 1, wherein said elastic ring member is an O-ring.

6. The ink-jet head as claimed in claim 1, wherein said fixing mechanism includes a plurality of screws for screwing together said head portion and said ink feeding portion and at least one collar for forming a spacer between said head portion and said ink feeding portion.

7. The ink-jet head as claimed in claim 1, wherein:

said head portion includes a frame lid for accommodating a head segment;

said ink feeding portion includes an ink tank and a supporting member;

said ink feeding passage is formed by a pipe and an ink feeding path which communicate with each other;

said pipe is formed in said head portion so as to protrude out of an aperture portion formed in said frame lid of said head portion; and said ink feeding path is a flexible tube connected between said ink tank and said supporting member of said ink feeding portion.

8. The ink-jet head as claimed in claim 7, wherein said elastic ring member is an O-ring.

9. The ink-jet head as claimed in claim 7, wherein said fixing mechanism includes a plurality of screws for screwing together said head portion and said ink feeding portion and at least one collar for forming a spacer between said head portion and said ink feeding portion.

10. The ink-jet head as claimed in claim 7, wherein:

said elastic ring member holds a corresponding said pipe of said ink feeding passage;

said aperture portion is step-shaped with an enlarged aperture facing to said ink feeding portion; and said rigid ring portion is a wall portion of said enlarged aperture.

11. The ink-jet head as claimed in claim 7, wherein said elastic ring member, which is sandwiched between said ink feeding path and said frame lid of said head portion, is movable together with said pipe in a diameter direction of said pipe.

12. A printer having an ink-jet head, said ink-jet head comprising:

a head portion;

an ink feeding portion;

an ink feeding passage connecting said head portion and said ink feeding portion; said ink feeding passage comprising: an elastic ring member holding said ink feeding passage; and a unitary rigid ring portion unitary to said ink feeding portion for housing said elastic ring member; and a fixing mechanism for pressing said elastic ring member between said head portion and said ink feeding portion such that said elastic ring deforms uniformly in a sideward direction and a vertical direction.

13. The ink-jet head as claimed in claim 12, wherein:

said head portion includes a frame lid for accommodating a plurality of head segments;

said ink feeding portion has includes an ink cartridge and an ink cartridge holder;

said ink feeding passage is formed by a pipe and an ink feeding path which communicate with each other;

said pipe is formed in said head portion so as to protrude out of an aperture portion formed in said frame lid of said head portion;

said ink feeding path is formed in and protrude out of said ink feeding portion;

said elastic ring member is an O-ring; and said fixing mechanism includes a plurality of screws for screwing together said head portion and said ink feeding portion and at least one collar for forming a spacer between said head portion and said ink feeding portion.

14. The ink-jet head as claimed in claim 13, wherein:

said elastic ring member holds said pipe of said ink feeding passage;

said aperture portion is step-shaped with an enlarged aperture facing to said ink feeding portion; and said rigid ring portion is a wall portion of said enlarged aperture.

15. The ink-jet head as claimed in claim 14, wherein said elastic ring member, which is sandwiched between said ink feeding path and said frame lid of said head portion, is movable together with said pipe in a diameter direction of said pipe.

16. The ink-jet head as claimed in claim 12, wherein:

said head portion includes a frame lid for accommodating a plurality of head segments;

said ink feeding portion includes an ink tank and a supporting member;

said ink feeding passage is formed by a pipe and an ink feeding paths which communicate with each other;

said pipe is formed in said head portion so as to protrude out of an aperture portion formed in said frame lid of said head portion;

said ink feeding path is a flexible tube connected between said ink tank and said supporting member of said ink feeding portion;

said elastic ring member is an O-ring; and said fixing mechanism includes a plurality of screws for screwing together said head portion and said ink feeding portion and at least one collar for forming a spacer between said head portion and said ink feeding portion.

17. The ink-jet head as claimed in claim 16, wherein:

said elastic ring member holds said pipe of said ink feeding passage;

said aperture portion is step-shaped with an enlarged aperture facing to said ink feeding portion; and said rigid ring portion is a wall portion of said enlarged aperture.

18. The ink-jet head as claimed in claim 16, wherein said elastic ring member, which is sandwiched between said ink feeding path and said frame lid of said head portion, is movable together with said pipe in a diameter direction of said pipe.

* * * * *